US006210210B1

(12) United States Patent
Kozel et al.

(10) Patent No.: US 6,210,210 B1
(45) Date of Patent: Apr. 3, 2001

(54) FLAT CONDUCTOR TERMINATION DEVICE

(75) Inventors: Charles A. Kozel, McHenry; John T. Scheitz, Barrington, both of IL (US)

(73) Assignee: Methode Electronics, Inc., Chicago, IL (US)

( * ) Notice: Subject to any disclaimer, the term of this patent is extended or adjusted under 35 U.S.C. 154(b) by 0 days.

(21) Appl. No.: 09/506,300

(22) Filed: Feb. 17, 2000

(51) Int. Cl.[7] ..... H01R 12/24
(52) U.S. Cl. ..... 439/495; 439/930
(58) Field of Search ..... 439/493, 495, 439/930, 863, 849, 850, 492

(56) References Cited

U.S. PATENT DOCUMENTS

| | | | | |
|---|---|---|---|---|
| 3,168,617 | * | 2/1965 | Richter | 174/117 FF |
| 3,802,974 | * | 4/1974 | Emmel | 156/55 |
| 4,252,393 | | 2/1981 | Johnson . | |
| 4,573,752 | | 3/1986 | Rich . | |
| 5,250,127 | * | 10/1993 | Hara | 156/52 |
| 5,427,552 | * | 6/1995 | Zielinski et al. | 439/849 |
| 5,733,154 | * | 3/1998 | Libregts | 439/850 |
| 5,895,287 | | 4/1999 | Seto et al. | 439/495 |
| 5,921,785 | | 7/1999 | Ii | 439/60 |
| 5,928,027 | | 7/1999 | Kunishi | 439/495 |
| 5,954,537 | | 7/1999 | Sonobe et al. | 439/495 |
| 5,961,344 | * | 10/1999 | Rosales et al. | 439/495 |
| 6,010,357 | | 1/2000 | Kunishi | 439/495 |
| 6,010,358 | | 1/2000 | Ii | 439/496 |
| 6,015,310 | | 1/2000 | Tojo | 439/260 |

OTHER PUBLICATIONS

Mortier, "The Future of Fully Flat Automotive Cabling", Connector Specifier, pp. 14,15, & 17, Feb. 2000.

* cited by examiner

*Primary Examiner*—Brian Sircus
*Assistant Examiner*—Hae Moon Hyeon
(74) *Attorney, Agent, or Firm*—Karl D. Kovach; David L. Newman

(57) ABSTRACT

An electrical connection termination device includes a box contact which accommodates a flat conductor of a flat cable. The flat cable includes an insulative layer substantially covering the flat conductor. The box contact includes a box structure at one end and a strain relief structure at another end. The box structure includes four sides so as to form the shape of a box having open ends. One of the sides of the box structure includes a flexible tab. The strain relief structure attaches to the insulative layer of the flat cable. The flat conductor extends through the open ends of the box structure and is positioned near one of the sides of the box structure where that particular side opposes the side of the box structure having the flexible tab.

3 Claims, 4 Drawing Sheets

FLAT CONDUCTOR TERMINATION DEVICE

BACKGROUND OF THE INVENTION

1. Field of the Invention

The present invention pertains to an electrical connector. The invention more particularly concerns a device for the termination of a flat conductor of a flat cable.

2. Discussion of the Background

One of the most undesirable occurrences in the automotive industry is the recall of vehicles due to the presence of a defect or a potential defect. The recall of vehicles is undesirable since it is costly and tarnishes the reputation of the manufacturer. Many of the recall notices concern the electrical system of the recalled vehicles. It is believed that an overwhelming majority of the electrical system recall notices concern the improper or defective crimping of a box contact to stranded conductors of a cable. Typically, an improper or defective crimp involves either an over-crimping or an under-crimping of the box contact to the stranded conductors of the cable.

An over-crimped wire can cause the individual conductor strands of the wire to break and fray, thus causing the electrical circuit to eventually fail due to a short or open circuit. An under-crimped cable can lead to the oxidation and corrosion of the individual strands of the cable thus causing an open circuit since electricity does not flow from the conductors to the box contact at the location of the crimp.

Typically, many cables are grouped together in a harness assembly. Each cable is individually terminated in its respective box contact. Then the harness assembly is routed throughout the body of the vehicle. The termination of the cables is labor intensive.

In spite of the problems associated with box contacts, box contacts are a commodity item in the automotive industry and, as such, are well understood and have gained wide acceptance. In practice it is typical to have many of the box contacts inserted into an insulative housing so as to simplify the almost simultaneous connection of many electrical circuits. FIG. 4 is a perspective view of a typical box contact 80. FIG. 5 is a view of FIG. 4 showing a crimp 82 of the box contact 80 to the conductors 96 of the cable 98 and a strain relief crimp 84 between the box contact 80 and the insulative layer 94 of the cable 98. To complete the electrical circuit a post is introduced into the box contact. Thus, ideally, the stranded conductors 96 make electrical contact with the box contact 80 at the crimp 82 of the box contact 80 and then the box contact 80 makes electrical contact with the post (not shown) via a conductive flexible tab 86 located in a box structure 89 of the box contact 80. The box contact 80 is so named since its box structure 89 has a first side 81, a second side 83, a third side 85, and a fourth side 87. The box structure 89 forms an aperture 88 which terminates at a rim 90. The first side 81 includes the flexible tab 86. The box structure 89 further has an interior surface 91 and an exterior surface 92.

Therefore, there is a need for a more reliable electrical harness assembly.

SUMMARY OF THE INVENTION

Therefore, it is an object of the present invention to provide a reliable electrical connection between the conductors of the cable and the post.

It is still another object of the invention to provide an electrical connection device which is economical.

Yet another object of the invention is to provide an electrical connection device which employs the box contact structure.

It is a further object of the invention to provide an electrical connection device which is easy to install.

It is still another object of the invention to provide an electrical connection device which does not directly crimp the conductors.

In one form of the invention, the electrical connection device employs the use of a flat conductor of a flat cable in conjunction with a modified box contact. Only now, with the recent advent of flat cable having flat conductors sandwiched between insulative layers, can such cabling be used economically in industrial applications. A flat cable design is disclosed in U.S. Pat. No. 6,026,563, which is hereby incorporated herein by reference. FIG. 6 is a perspective view of a flat cable 100 having flat conductors 102 which have a width greater than their thickness. The flat conductors 102 are retained in the flat cable 100 by the upper and lower insulative layers 104, 106 which are sonically welded to each other so as to form a unified insulative layer 108. Thus, the flat conductors 102 have no adhesive residue which must be removed so as to ensure a reliable electrical connection between itself and another component or device.

Sonically welded flat cable is capable of carrying relatively large current loads, is economically competitive, is flexible, is light in weight, and has a low profile. The low profile aspect of flat cable makes it an ideal candidate for electrical cabling to be used in headliner, dashboard, and door insert installations of automobiles. The low profile of flat cable enables the headliner and doors of automobiles to become thinner thus increasing passenger space. Furthermore, the inline spacing of the conductors of the flat cable provides for the gang installation of conductors into respective box contacts and also eliminates the crimp of the box contact directly to the conductor, which is a cost savings. Thus, sonically welded flat cabling is superior to traditional stranded conductor wire in certain respects and as such has extensive industrial applicability. Therefore, ideally, flat cable would be used in place of stranded conductor wire while maintaining the use of the widely accepted box contact type of structure. The automotive industry is just one example of the industrial applicability of flat cable and the termination of the flat conductor of the flat cable.

Further features of the device of the invention include a box structure at one end of the box contact and a strain relief structure at another end of the box contact. The box structure includes a first side, a second side, a third side, and a fourth side so as to form an aperture. The first side includes a flexible tab extending into the aperture. The flexible tab has resilient properties. The third side opposes the first side. The strain relief structure is attachable directly to a surface of the insulative layer, where the insulative layer covers the conductor. Thus, the strain relief structure applies a compressive force to the composite structure of the insulative layer covering the conductor. The flat conductor is extendable through the aperture and is positionable adjacent the third side of the box structure.

In use, a post is introduced into the aperture of the box contact. Upon insertion, the post deflects the flexible tab. The deflected, resilient, flexible tab compresses the post against the flat conductor and the flat conductor is urged toward the stationary third side. Therefore the post contacts the flat conductor. The post then conveys electricity to another device. Thus, the conductor makes direct electrical contact with the post. Therefore, the primary purpose of the box contact is not to convey electricity, but the box contact can be modified so as to conduct electricity.

Thus, the device of the invention is superior to existing box contacts. The termination device of the invention eliminates an electrical component (the box contact) and two electrical connections (conductor to box contact crimp, and box contact to post) as compared to the prior art, and replaces them with a direct electrical connection between the conductor and the post. A modified box contact remains, but the box conductor need not conduct electricity. Specifically, the troublesome electrical connection between the box contact crimp and the stranded conductors has been eliminated. Thus, the device of the invention is more reliable than the prior art device.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PRESENTLY PREFERRED EMBODIMENT

Figure 1:
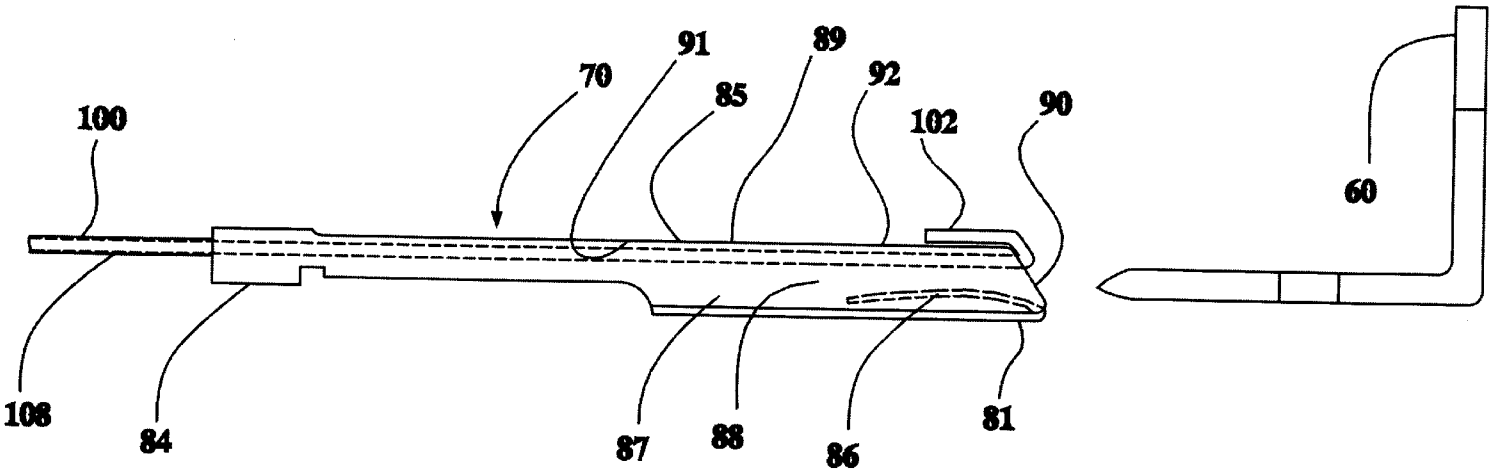
FIG. 1 is a side view of a flat conductor box contact and a post.
Figure 2:
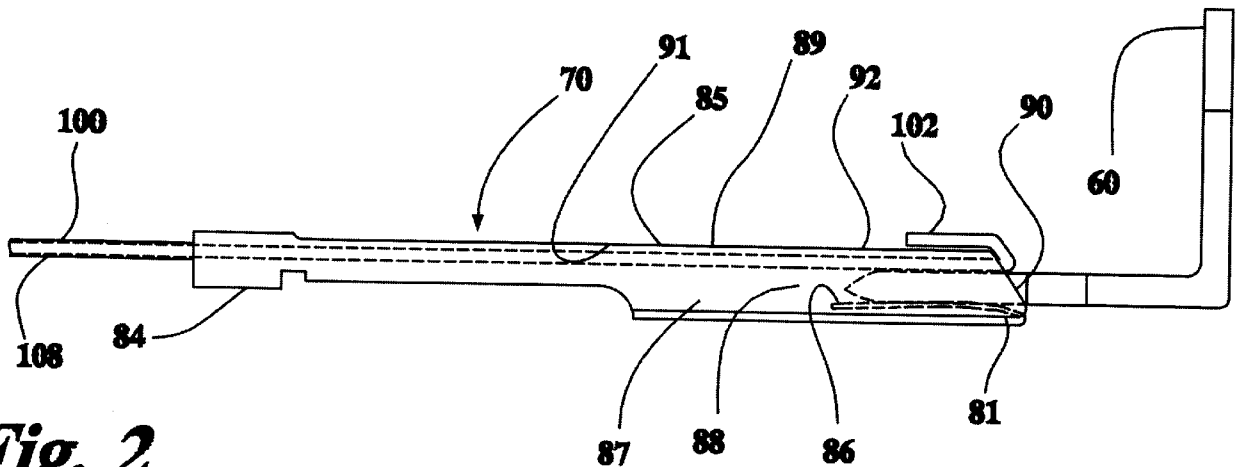
FIG. 2 is a side view of the flat conductor box contact of FIG. 1 with the post engaged.
Figure 3:
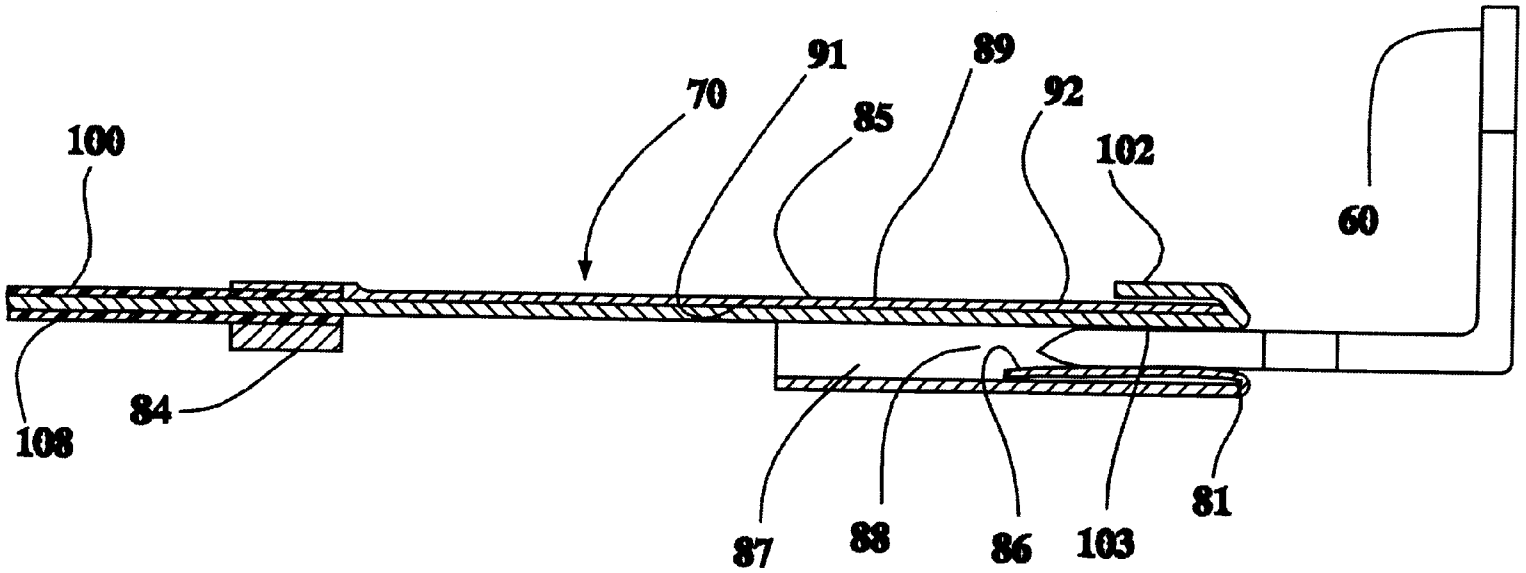
FIG. 3 is a cross-sectional view of the flat conductor box contact of FIG. 2.

Referring now to the drawings, wherein like reference numerals designate identical or corresponding parts throughout the several views, and more particularly to FIGS. 1–3 thereof, an embodiment of the present invention is a flat conductor termination device 70.

Figure 4:
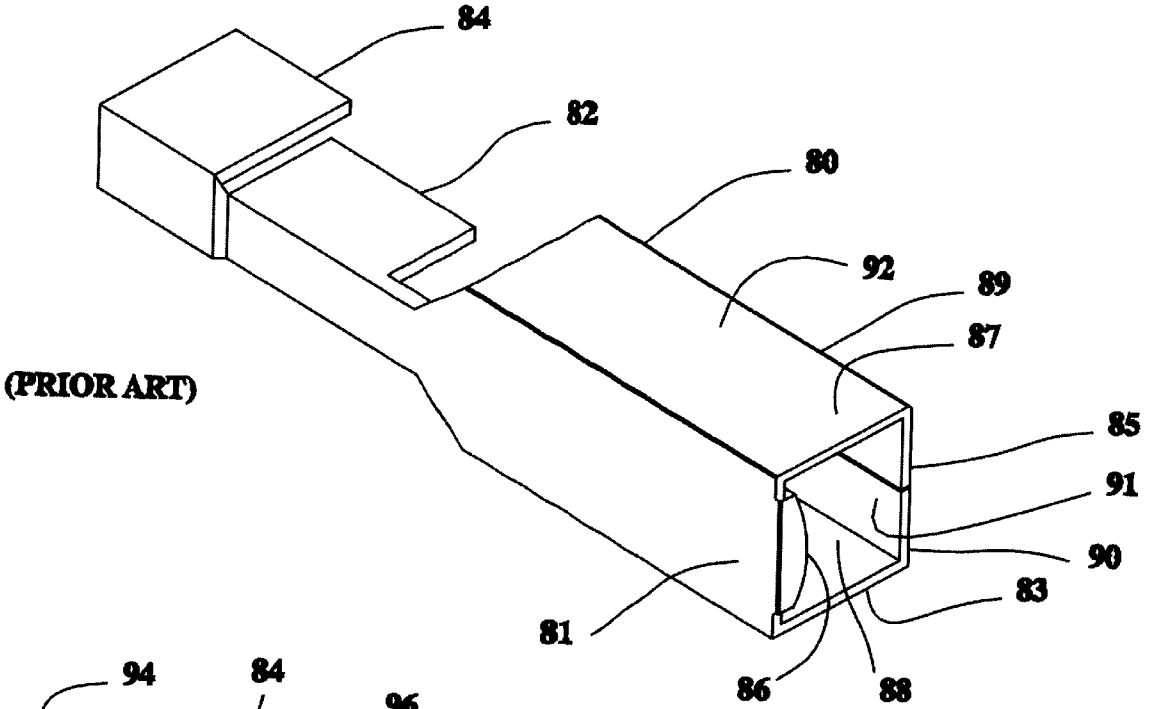
FIG. 4 is a perspective view of a typical box contact.
Figure 5:
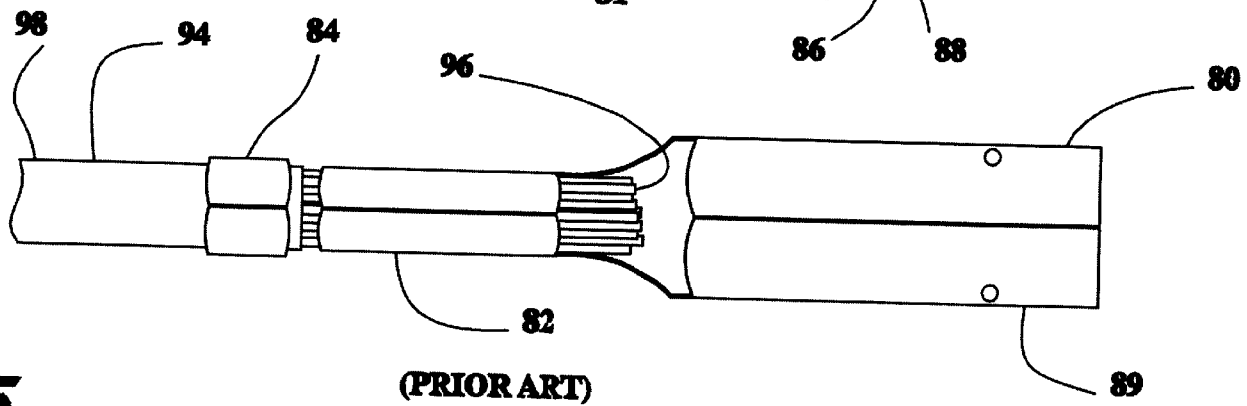
FIG. 5 is a view of the typical box contact of FIG. 4 attached to stranded conductors of an insulated cable.
Figure 6:
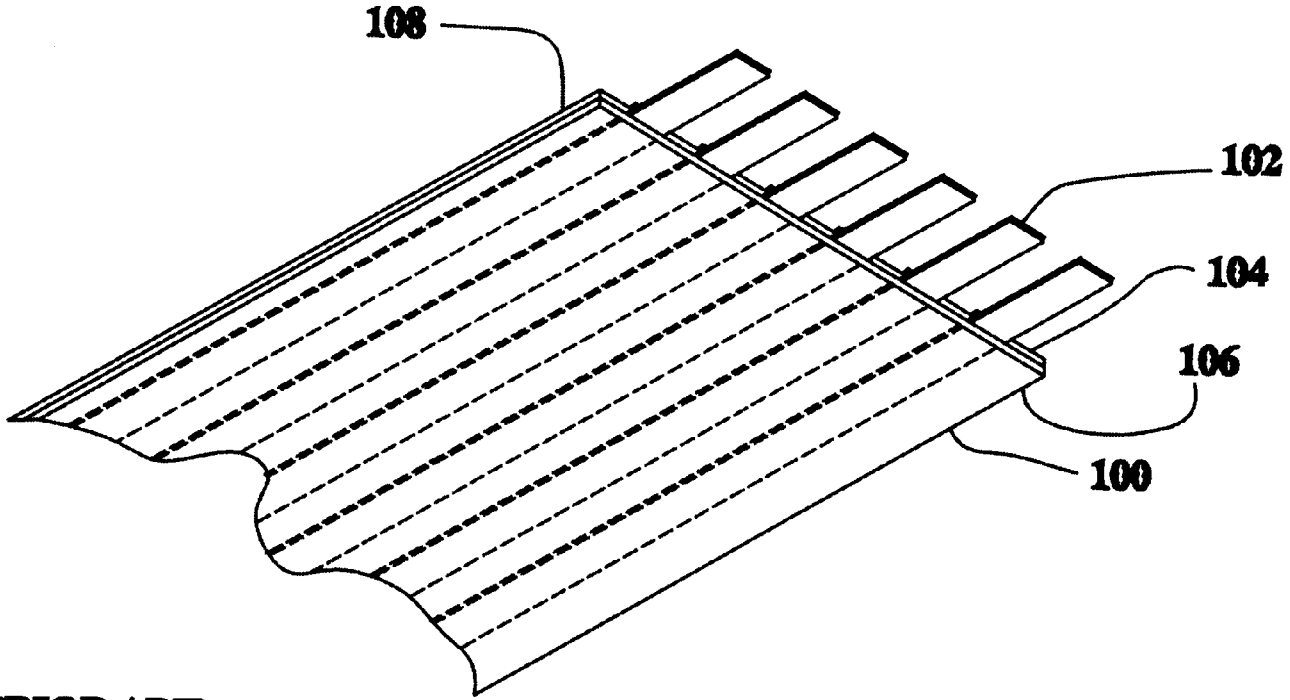
(PRIOR ART) Fig. 6
FIG. 6 is a perspective view of a typical flat cable after an end portion has been stripped to expose the flat conductors.

FIG. 1 is a side view of the flat conductor termination device 70 which may also be known as a flat conductor box contact. Also shown is a post 60 which mates with the termination device 70. FIG. 1 shows the flat conductor 102 of the flat cable 100 passing through the aperture 88 of the box structure 89. The box structure 89 shown in FIGS. 1 and 2 is similar to the box structure shown in FIGS. 4 and 5. The flat conductor 102 is bent around the rim 90 of the box structure 89 of the termination device 70 and exists adjacent an exterior surface 92 and an interior surface 91 of a third side 85. Unlike the box contact 80 shown in FIGS. 4 and 5, the termination device 70 shown in FIGS. 1 and 2 does not have a crimp 82.

The termination device 70 has a strain relief crimp 84 which crimps onto the insulative layer 108 of the flat cable 100. A flexible tab 86 projects from a first side 81 of the box structure 89 of the termination device 70. The flexible tab 86 may be cut away from a portion of the first side 81 which is later bent so as to project into the aperture 88 or the flexible tab 86 may be a resilient member such as an elastomer or rubber material which is attached to the first side 81. The flexible tab 86 is shown in phantom line since the fourth side 87 blocks direct view of the flexible tab 86 from the side. Also, a portion of the flat conductor 102 which is located within the aperture 88 is shown in phantom line.

FIG. 3 is a cross-sectional view of the termination device 70 as shown in FIG. 2. FIG. 3 clearly shows the direct contact of the strain relief crimp 84 and the insulative layer 108, where the portion of the insulative layer 108 covers the conductor 102. Thus, the strain relief crimp 84 applies a compressive force to the insulative layer 108 and the conductor 102. Furthermore, FIG. 3 clearly shows the generous line of contact 103 between the post 60 and the conductor 102.

In practice, the post 60 is introduced into the aperture 88 of the termination device 70. When the post 60 is fully engaged with the aperture 88 of the termination device 70, the flexible tab 86 is deflected or deformed as shown in FIGS. 2 and 3. The resiliency of the deflected or deformed flexible tab 86 causes the post 60 to be pushed or urged against the flat conductor 102 so as to form a reliable electrical connection. Since the post 60 directly contacts the flat conductor 102, the termination device 70 need not be made of a conductive material. The post 60 then conveys the electrical signal or current to other devices.

Obviously, numerous modifications and variations of the present invention are possible in light of the above teachings. It is therefore to be understood that within the scope of the appended claims, the invention may be practiced otherwise than as specifically described herein.

What is claimed is:

1. An electrical connection termination device for connecting to a flat cable where the flat cable includes a flat conductor and an insulative layer, the electrical connection termination device comprising:

a box contact having a box structure at a first end and a strain relief structure at a second end, the box structure having a first side, a second side, a third side, and a fourth side so as to form an aperture, the first side having a flexible tab extending into the aperture, and the third side opposes the first side, and wherein the strain relief structure is attachable to the insulative layer, and wherein the flat conductor is extendable through the aperture and is positionable adjacent the third side of the box structure, and wherein the first side, the second side, the third side, and the fourth side each have a respective edge which forms a rim surrounding an opening of the aperture, and wherein the box structure has an interior surface facing the aperture, and an exterior surface, and wherein the flat conductor is folded over the edge so as to be positioned adjacent the exterior surface so as to prevent the flat conductor from being pushed into the aperture when a post is introduced into the aperture.

2. The electrical connection termination device according to claim 1 wherein the flexible tab has resilient properties.

3. The electrical connection termination device according to claim 1 wherein, in a connected position, the post is introduced into the aperture so as to deflect the flexible tab and to urge the flat conductor against the third side so as to provide an electrical connection between the post and the flat conductor.

* * * * *